United States Patent [19]

Meshberg

[11] 4,284,211

[45] Aug. 18, 1981

[54] NIBBED FERRULE FOR HOLDING CAP

[75] Inventor: Emil Meshberg, Fairfield, Conn.

[73] Assignee: Emson Research, Inc., Bridgeport, Conn.

[21] Appl. No.: 78,947

[22] Filed: Sep. 26, 1979

[51] Int. Cl.[3] ..... B67B 3/02

[52] U.S. Cl. ..... 222/182; 220/356

[58] Field of Search ..... 222/182, 562; 220/356

[56] References Cited

U.S. PATENT DOCUMENTS

| | | | |
|---|---|---|---|
| 2,714,475 | 8/1955 | Roehrich | 222/182 X |
| 3,112,048 | 11/1963 | Finkenzeller | 222/182 X |
| 3,269,609 | 8/1966 | Ahrens | 222/182 |
| 3,500,761 | 3/1970 | Clevenger et al. | 222/182 X |
| 3,907,171 | 9/1975 | Pearson | 222/182 |
| 4,113,145 | 9/1978 | Meshberg | 222/321 X |

FOREIGN PATENT DOCUMENTS

| | | | |
|---|---|---|---|
| 661459 | 4/1963 | Canada | 222/182 |
| 1000042 | 8/1965 | United Kingdom | 222/182 |

*Primary Examiner*—Charles A. Marmor

*Attorney, Agent, or Firm*—Kenyon & Kenyon

[57] ABSTRACT

A container having a neck with a lip is closed by a sheet metal ferrule that has an end pressing a gasket against the end of the neck. A cylindrical part of the ferrule extends along the neck and engages the lip. Transversely arranged, outwardly extending nibs project from the ferrule nearer the end surface than to the end of the skirt to engage a cylindrical skirt portion of a cover.

1 Claim, 6 Drawing Figures

NIBBED FERRULE FOR HOLDING CAP

FIELD OF THE INVENTION

This invention relates to closures and covers to containers. More particularly, the invention relates to closures in which a covering, such as a cap or collar, is frictionally engaged and retained on the container.

DISCUSSION OF THE PRIOR ART

In the cosmetic industry it is usual to fasten a dispenser into a bottle or can containing a cosmetic substance to be dispensed. Various structures have been used for holding a cap, a cover, or a collar over such a dispenser on the end of the container. One arrangement employs a metal ferrule which surrounds the lip of the bottle's neck and which is retained on the lip by means of a dependant flange which is deformed, by pressing, into conformity with the rounded, lower portion of the lip. The dispenser has a radially projecting flange which extends out of the body of the pump where it passes through the neck of the bottle and which rests on the open end of the bottle. The flange is caught and retained under an end wall of the ferrule which extends inward toward the axis of the bottle and locks the pump in place.

In the past, caps and covers for the dispenser assembly have been fitted on the ferrule in various ways. In one instance a tubular aluminum slip shell, which is permanently deformed from its original circular cross-section to give it a somewhat triangular cross-section, is fitted over the outside of the ferrule. Because the dimensions of the shell are chosen so that the outside diameter of the ferrule "interferes" with the minimum inside radius of the shell along a substantial position of the perimeter, the cover is forced back towards its original, round configuration and is retained on the ferrule by the resulting friction.

The closure just described has two major shortcomings. First, because so much of the circumference of the ferrule comes into contact with the inside wall of the slip shell, a high degree of galling occurs and this wearing away by friction roughens the surface of the slip shell as well as marring the exterior of the ferrule, making it difficult to move the cap on and off, as well as scratching the visible exterior of the ferrule. In the case of anodized aluminum ferrules, the exterior of the ferrule is made doubly unattractive by the consequent destruction of the anodization. Second, the effective inside diameter at the opening of a triangulated slip shell is smaller than the effective inside diameter further into the cap, since the deeper one measures into the cap, the larger the effective inside diameter becomes. The binding action of the cap is therefore greatest near the cap opening, and the further the ferrule is inserted into the cap, the more loosely the cap fits. The resulting, wobbly, fit makes this type of cap undesirable for use on closures having long necks, pumps and the like, where it is necessary to cover more of the projecting structure than just the ferrule.

In another structure, a triangular fit is used for interference attachment of a collar for covering a ferrule to enhance the appearance of the package. Ferrules are usually given a protective coating by bulk anodizing and are therefore not very attractive. Therefore, in many instances, the cosmetic industry places a buffed and lacquered collar over the ferrule to cover it and to improve the appearance of the package. Such a collar is engaged on the ferrule by means of integral ribs formed by pressing in the sheet metal of the collar. The ribs extend downward on the cylindrical wall of the cover for a substantial distance from the flanged portion of the collar which covers over the large top surface of the ferrule. The effect is most noticeable on long collars because the ribs are long indentations in the surface of the collar's wall. The ribs, usually three in number, are highly visible and detract from the aesthetics of the package.

It is an object of the present invention to provide a simple, new and improved structure for frictionally attaching a slip cover or cap to a container which is inexpensive and overcomes the objections described.

SUMMARY OF THE INVENTION

The present invention meets these objectives by providing a number of laterally projecting nibs, spaced apart, on the circumference of that part of the container which engages the covering. A cap or collar is then fitted on, which has a diameter which is sufficiently small to be interfered with by the nibs and to be deformed by the resulting pressure. Since the cap has a uniform inside diameter, the friction developed by the restoring force in the deformed cover remains essentially constant, regardless of how far the cap is pushed onto or off of the ferrule. In addition, the diameter of the cap may be chosen so that when it is placed on the ferrule, its only contact with the ferrule is at the points where there are nibs. Any galling effect is thus substantially transferred to the nibs. When three nibs are used, the cap or cover is, in effect, triangulated to fit, and the deformation of the cap, so produced, results in consistent frictional engagement and provides a good "feel" of tightness when removing or putting the cap in place. When this structure is used for attaching a collar to a ferrule, no ribs are exposed to view and the ferrule is hidden under a smooth walled collar.

DETAILED DESCRIPTION OF THE INVENTION

Figure 1:
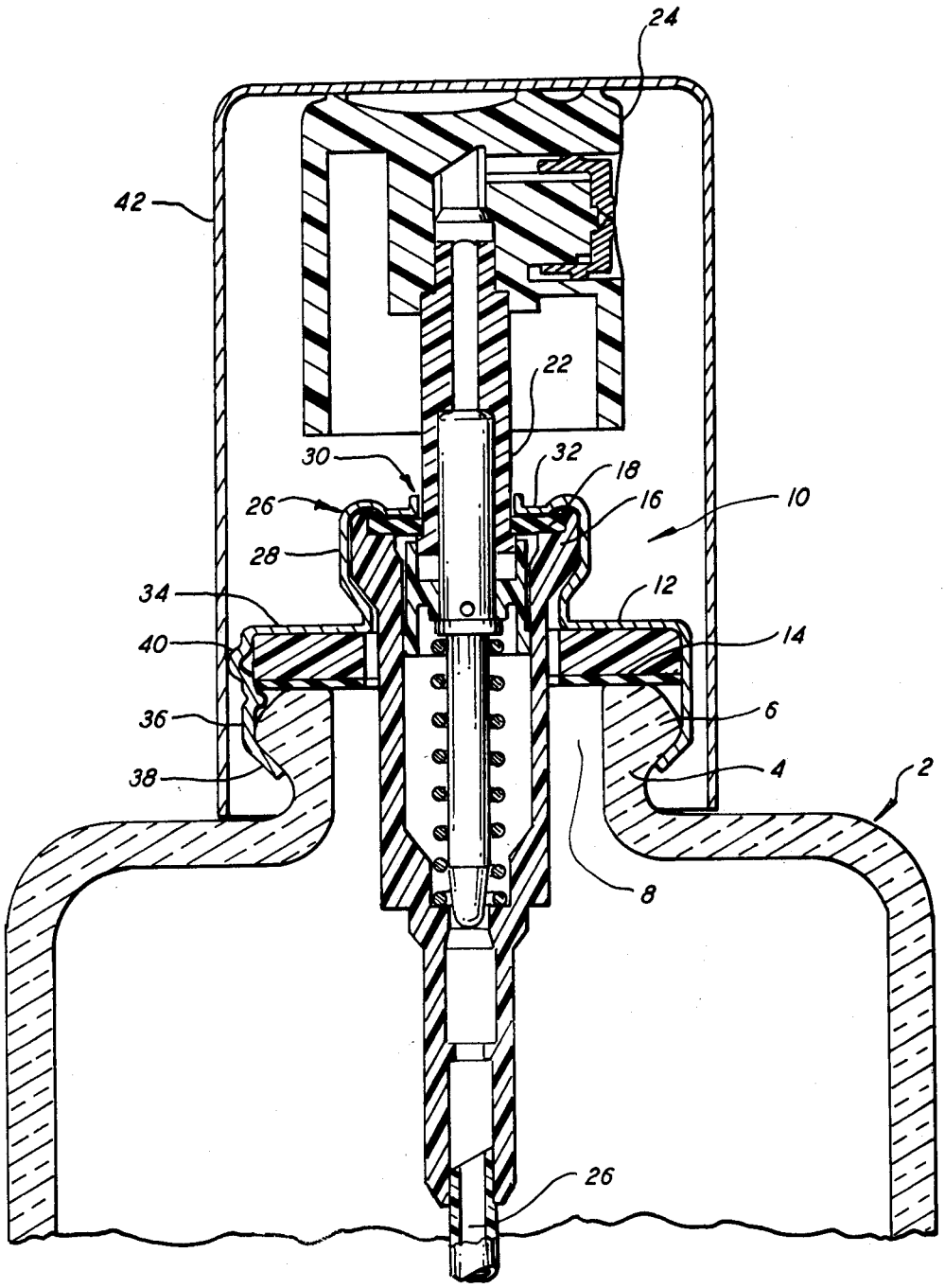
FIG. 1 is a partial view, in cross-section, of a portion of a bottle, dispenser, and cap embodying the teachings of the invention.

Reference is now made to FIG. 1 which illustrates the application of the invention to an otherwise conventional package for dispensing a product by means of an actuated dispenser. In FIG. 1, the container includes a glass envelope 2 having a neck portion 4 which is reduced in diameter and ends in a rounded lip portion 6 surrounding the opening 8 in the end of the bottle. A dispenser 10 having a flange 12 projecting radially from its body 16 is seated against the end surface of neck 4 on gasket 14. Dispenser body 16 extends well into the neck of the bottle and also has a projecting portion which extends axially outside of the bottle. The upper end face of body 16 is closed by a gasket 18 through which drive cylinder 22 projects. Driver cylinder 22 carries, on its upper end, an actuator 24 by means of which finger pressure may be applied to the dispenser and through which the contents of the container are then laterally dispensed as a spray. The lower portion of dispenser body 16 carries a dependent tube 26 which extends to a point near the bottom of bottle 2 for gathering material to be pumped out. This dispenser, which is shown for illustrative purposes, may be, for example, of the type shown in FIG. 1 of U.S. Pat. No. 4,113,145, entitled DISPENSING UNIT FOR LIQUID AND METHOD OF DISPENSING.

Dispenser assembly 10 is maintained in place in neck 4 of bottle 2 by means of ferrule 26. Ferrule 26 has two connected cylindrical sections of different diameters. The upper section 28, of reduced diameter, encloses the projecting portion of dispenser body 16, and provides a flanged aperture 30 for passage of dispenser actuating stem 2. End wall 32, which contains aperture 30, holds gasket 18 and thus prevents leakage around actuator stem 22. The larger section 36 of ferrule 26 is connected to outer section 28 by surface 34 and serves as a shoulder for retaining radial flange 12 of dispenser 10 on the bottle. It is connected to dependent skirt 36, the lower lip 38 of which is turned inward, being conformably fitted onto the lower surface of rounded lip 6, locking the dispenser in place.

One of three radially projecting, horizontal nibs 40 is visible, in profile, in FIG. 1 on the left side of ferrule 26 where depending skirt 36 adjoins the transverse surface 34. Nib 40 contacts the inside side wall surface of cover 42, shown here as a slip cylindrical shell which is closed on one end, and acts, in concert with two other nibs 40 (not visible in FIG. 1), to produce a slight triangular deformation of cylindrical slip shell 42. As shown in FIG. 1, the inner surface of slip shell 42 touches the surface of ferrule 26 only at the point of engagement with a nib 40.

Figure 2:
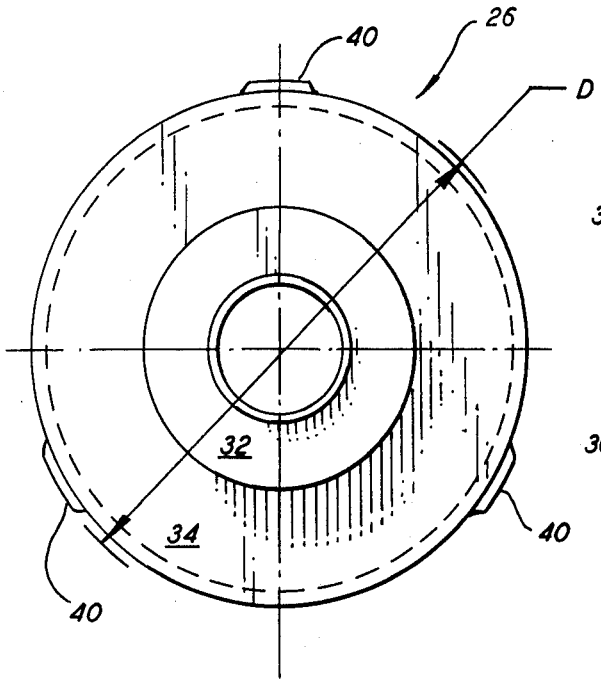
FIG. 2 is a plan view of the ferrule used in the structure of FIG. 1.
Figure 3:
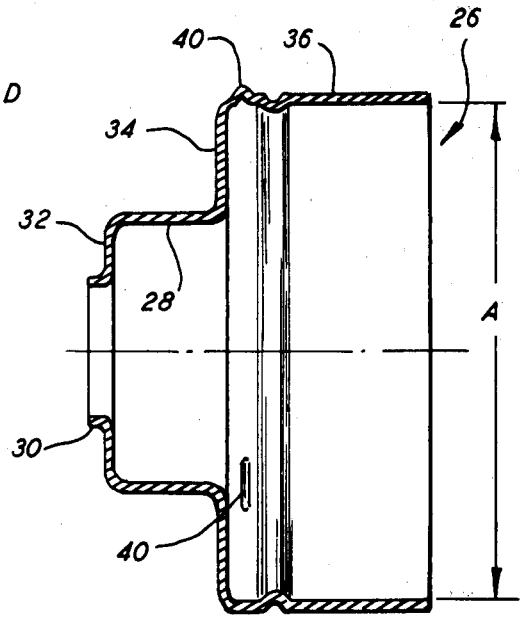
FIG. 3 is a view, in cross-section, of the ferrule of FIG. 2.

Details of ferrule 26 may be seen in FIGS. 2 and 3. Three nibs 40 are located, as shown, at points spaced equally around the outer circumference of ferrule 26. Axially speaking, they are located closer to end surface 34 of the ferrule, then to the portion of the ferrule which is bent over to conform to the lip of the bottle. As can be seen in FIG. 1 the large diameter section 36 of ferrule 26 includes wall space between nib 40 and the bent over portion 38. Gasket 14 is in contact with this wall and lip 6 and, like gasket 18, provides a seal against leakage. The outer periphery of each rib 40 lies, approximately, on a circle of diameter D, as may be seen in FIG. 2. The dimension D is thus the maximum for the inner diameter of any mating cap or cover. The actual inner diameter of slip 42 will, it will be understood, be chosen to be slightly smaller than diameter D so that exertion of a slight pressure on the end of shell 42 will be required in order to force the cap to slide onto nibs 40. If the inner diameter of the cap is made too large, the cap will, of course, fit loosely over nibs 40 and frictional engagement will not be obtained. On the other hand, the choice of too small an inner diameter for shell 42 will result in too large a deformation by the nibs 40, and the inner wall of the shell will contact the outer surface of ferrule skirt 36, rubbing its surface. In an extreme case, the cap will not be received over the ferrule because of direct interference by the body of the ferrule. In one embodiment of the invention, the wall of ferrule 26 was made of 0.016 inch aluminum sheet, the large inside diameter A of dependent skirt portion 36 was 0.670 inches, and the diameter D was $0.722 \pm 0.002$ inches; the length of the nib in the circumferential direction is about 0.115 inches. The elastically deformable slip shell was made of aluminum, 0.012 inches in thickness, and having an inner diameter of $0.7175 \pm 0.001$ inches.

Figure 5:
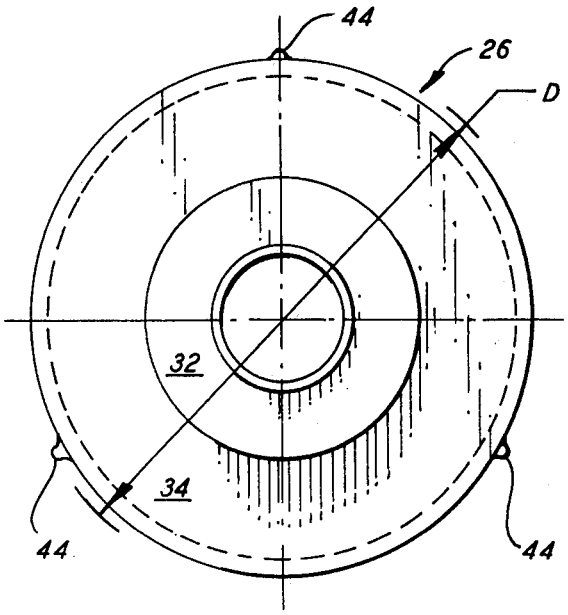
FIG. 5 is a plan view of the ferrule used in the structure of FIG. 4.
Figure 6:
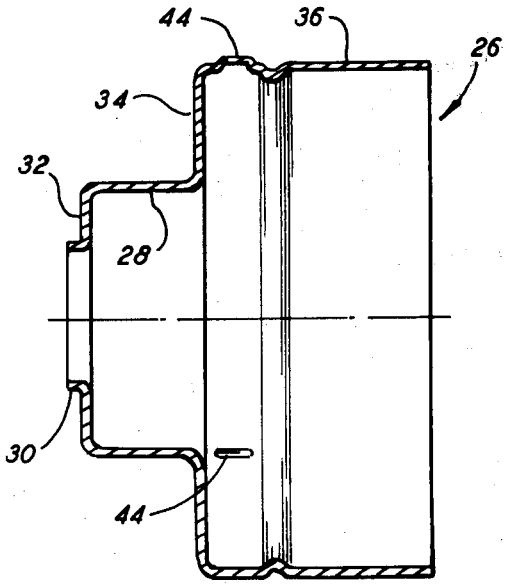
FIG. 6 is a side view, in cross-section, of the ferrule of FIG. 5.
Figure 4:
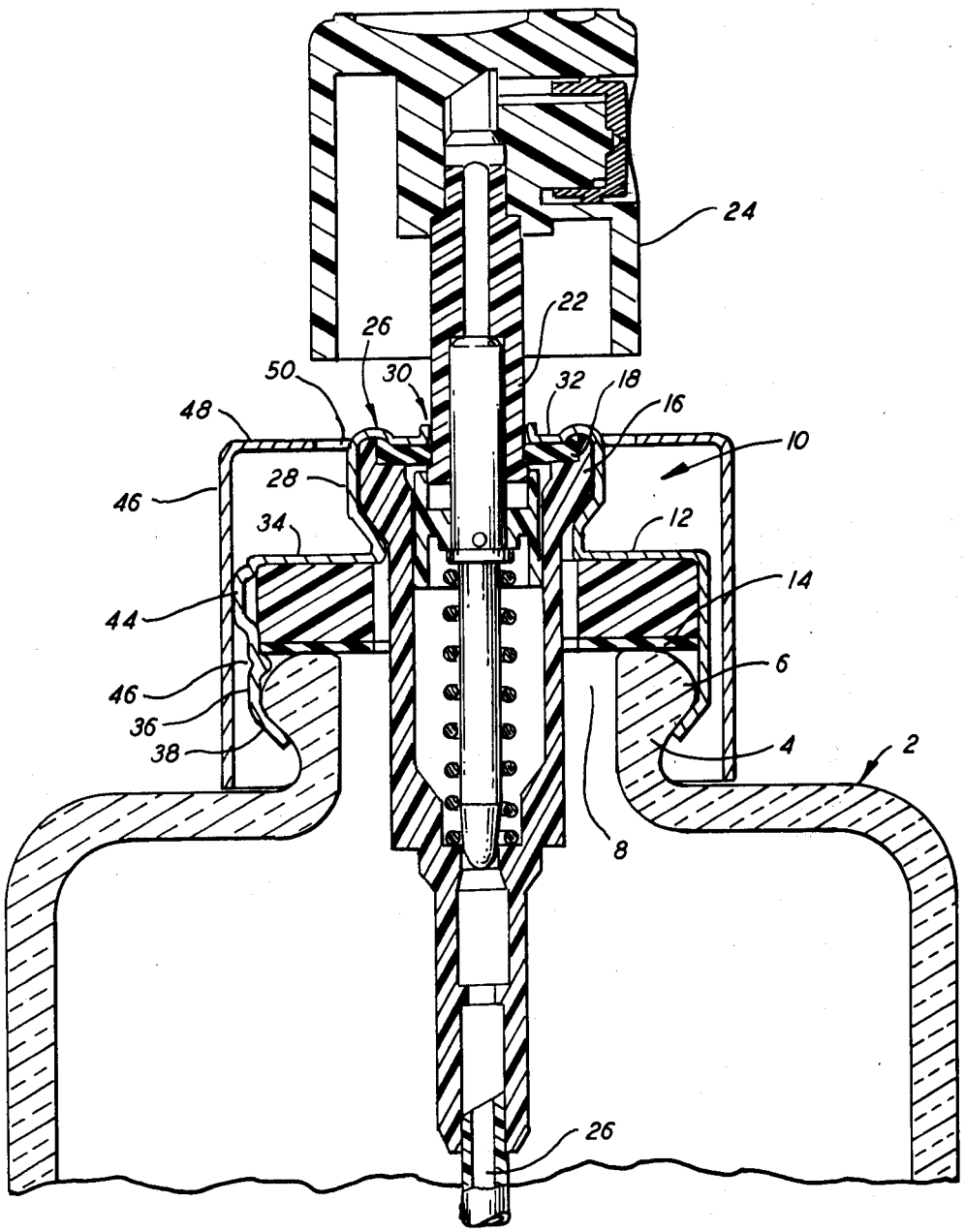
FIG. 4 is a partial view, in cross-section, of a portion of a ferrule, dispenser, and cover illustrating another embodiment of the invention.

FIGS. 4, 5 and 6 illustrate the application of the teachings of the invention to a structure for holding a ferrule cover in place. As shown in FIG. 4, vertically oriented nibs 44, of which, again, there are preferably three, form a flexible cover 46 using the same interference fit as was used in the example of FIG. 1. Cover 46 includes a turned-in portion 48 having a central opening 50 through which drive cylinder 22 of dispenser 10 projects. In the illustrated structure, the diameter of hole 50 is made sufficient to pass the depending skirt of actuator 24 by which finger pressure is applied to the actuator. Covers of this sort are useful in dispenser packages where the use of a removable cap is not desired.

The invention has been described with particular reference to closures for use on bottles having finger-actuated dispensers. It will be apparent to those skilled in the art that the principles of the invention are applicable to a wide variety of containers requiring covers and collars, such as those having aerosol valves. It is particularly useful for those structures for which inexpensive covers held on by friction are desired.

It will also be apparent that the invention is susceptible to application using a wide variety of materials.

While the preferred embodiment of the invention uses three ribs, it is apparent that the necessary force for maintaining a cover in place on an object may be generated by stretching a cover by means of one rib, allowing the inner surface of the cover to contact the outer surface of the object over a substantial portion of its periphery. Similarly, more than three ribs may be used. However, in terms of minimizing expense and abrasive effects upon the surfaces which are frictionally engaged, the three point construction is to be preferred.

What is claimed is:

1. A closure for a container having a neck and a lip on the neck of generally cylindrical configuration comprising:

a dispenser passing through the neck into the container, a sheet metal ferrule holding said dispenser in place, a circular gasket, through which the dispenser passes, extending between the ferrule and the lip, and a removable covering having a substantially cylindrical, elastically deformable surface for frictionally engaging the ferrule, said covering slidable on said ferrule for application and removal, said ferrule comprising a substantially cylindrical sheet metal body portion having an end surface through which the dispenser projects, said substantially cylindrical body portion receiving the neck, and a deformable skirt portion depending from said body portion and engaging the lip, at least three oblong nibs, oriented transverse to the direction of application and removal of said covering, projecting radially from the ferrule into engagement with said elastically deformable cylindrical surface of said covering, the nibs each comprising an outward deformation of the cylindrical body portion located between the end surface and the deformable skirt portion, the nibs placed closer, axially, to the end surface than to the deformable skirt portion, and axially spaced apart from the deformable skirt portion such that there remains an axially extending portion of said cylindrical body portion which is not deformed which provides a radial contact surface for the gasket to prevent leakage past said gasket, and the gasket radially in contact with said portion of cylindrical body portion which is not deformed, adjacent to the deformable skirt portion and seated on the lip.

* * * * *